US009120985B2

(12) United States Patent
Oldenburg et al.

(10) Patent No.: US 9,120,985 B2
(45) Date of Patent: Sep. 1, 2015

(54) CORROSION RESISTANT GASIFIER COMPONENTS

(75) Inventors: Paul D. Oldenburg, Easton, PA (US); Michael F. Raterman, Doylestown, PA (US)

(73) Assignee: EXXONMOBIL RESEARCH AND ENGINEERING COMPANY, Annandale, NJ (US)

( * ) Notice: Subject to any disclaimer, the term of this patent is extended or adjusted under 35 U.S.C. 154(b) by 1155 days.

(21) Appl. No.: 13/053,986

(22) Filed: Mar. 22, 2011

(65) Prior Publication Data

US 2011/0289842 A1 Dec. 1, 2011

Related U.S. Application Data

(60) Provisional application No. 61/348,365, filed on May 26, 2010.

(51) Int. Cl.

| | |
|---|---|
| ***C10J 3/46*** | (2006.01) |
| ***C10J 3/48*** | (2006.01) |
| ***C10J 3/74*** | (2006.01) |
| ***C10J 3/50*** | (2006.01) |
| ***C10J 3/76*** | (2006.01) |

(52) U.S. Cl.

CPC *C10J 3/485* (2013.01); *C10J 3/506* (2013.01); *C10J 3/74* (2013.01); *C10J 3/76* (2013.01); *C10J 2300/093* (2013.01); *C10J 2300/0916* (2013.01); *C10J 2300/0956* (2013.01); *C10J 2300/0959* (2013.01)

(58) Field of Classification Search

USPC ..... 48/61, 127.9, 127.1, 76, 69, 200–203, 48/71–73

See application file for complete search history.

(56) References Cited

U.S. PATENT DOCUMENTS

| | | | | |
|---|---|---|---|---|
| 4,183,456 | A * | 1/1980 | Schilling et al. | 228/175 |
| 4,191,500 | A | 3/1980 | Oberg et al. | |
| 4,666,463 | A * | 5/1987 | Stellaccio | 48/197 R |
| 4,670,407 | A | 6/1987 | Kiehl et al. | |
| 4,952,218 | A | 8/1990 | Lipp et al. | |

(Continued)

FOREIGN PATENT DOCUMENTS

| | | |
|---|---|---|
| WO | 9012769 | 11/1990 |
| WO | 2006081661 | 8/2006 |

(Continued)

OTHER PUBLICATIONS

G. Moskal; "Thermal barrier coatings: characteristics of microstructure and properties, generation and directions of development of bond," Journal of Achievements in Materials and Manufacturing Engineering, vol. 37, Issue 2, Dec. 2009, pp. 323-331.

*Primary Examiner* — Kaity Handal

(74) *Attorney, Agent, or Firm* — Bruce M. Bordelon; Chad A. Guice

(57) ABSTRACT

The present invention relates to an improved gasifier reactor design. In particular, the present invention relates to improved design of gasifier reactor faceplates, gasifier reactor walls, gasifier reactor cooling tubes, and gasifier reactor walls with integrated cooling channels. The present invention utilizes aluminum nitride and/or aluminum nitride/metal composite materials which promote many benefits to the present design herein, including improved corrosion and erosion resistively as compared to high alloy metal materials.

15 Claims, 3 Drawing Sheets

(56) References Cited

U.S. PATENT DOCUMENTS

| | | | | | |
|---|---|---|---|---|---|
| 4,956,318 | A | | 9/1990 | Moskowitz et al. | |
| 5,002,904 | A | | 3/1991 | Jain et al. | |
| 5,028,989 | A | | 7/1991 | Naganuma et al. | |
| 5,100,638 | A | | 3/1992 | Levin | |
| 5,133,403 | A | | 7/1992 | Yokono et al. | |
| 5,286,685 | A | | 2/1994 | Schoennahl et al. | |
| 5,336,280 | A | | 8/1994 | Dubots et al. | |
| 5,613,552 | A | | 3/1997 | Osakabe et al. | |
| 5,843,239 | A | * | 12/1998 | Shrotriya | 134/1.1 |
| 5,941,302 | A | * | 8/1999 | Hattori et al. | 165/151 |
| 5,943,859 | A | | 8/1999 | Kawamura | |
| 5,993,594 | A | | 11/1999 | Wicker et al. | |
| 6,103,651 | A | | 8/2000 | Leitzel | |
| 6,166,937 | A | | 12/2000 | Yamamura et al. | |
| 6,409,974 | B1 | | 6/2002 | Towler et al. | |
| 6,436,354 | B1 | | 8/2002 | Priegnitz et al. | |
| 6,887,286 | B1 | | 5/2005 | Taki et al. | |
| 7,015,426 | B2 | | 3/2006 | Doering et al. | |
| 7,037,473 | B1 | * | 5/2006 | Donner et al. | 422/242 |
| 2003/0159817 | A1 | | 8/2003 | Azuma | |
| 2004/0050982 | A1 | | 3/2004 | Sprouse et al. | |
| 2004/0069462 | A1 | | 4/2004 | Hashimoto | |
| 2005/0191233 | A1 | | 9/2005 | Jiang et al. | |
| 2006/0242907 | A1 | | 11/2006 | Sprouse et al. | |
| 2008/0006187 | A1 | | 1/2008 | Williams et al. | |
| 2008/0202028 | A1 | | 8/2008 | Tsangaris et al. | |
| 2008/0222956 | A1 | * | 9/2008 | Tsangaris et al. | 48/77 |
| 2009/0020456 | A1 | | 1/2009 | Tsangaris et al. | |
| 2010/0088959 | A1 | | 4/2010 | Meyer et al. | |

FOREIGN PATENT DOCUMENTS

| | | |
|---|---|---|
| WO | 2008104058 | 9/2008 |
| WO | 2009095144 | 8/2009 |

* cited by examiner

CORROSION RESISTANT GASIFIER COMPONENTS

This application claims the benefit of U.S. Provisional Application No. 61/348,365 filed May 26, 2010.

FIELD OF THE INVENTION

The present invention relates to entrained-flow gasifier reactor components with improved resistance to corrosive as well as erosive atmospheres within a gasifier reactor unit. In particular, the present invention provides for gasifier reactor components made from aluminum nitride based materials which exhibit improved characteristics over gasifier component materials of the prior art, in particular improved corrosion and erosion resistively.

BACKGROUND OF THE INVENTION

With increased use and decreasing availability of petroleum supplies, gasification technologies of economical solid and high boiling point liquid hydrocarbon sources such as, but not limited to tars, bitumens, crude resides, coal, petrochemical coke, and solid or liquid biomass are currently becoming more attractive technically and economically as a versatile and clean way to produce electricity, hydrogen, and other high quality transportation fuels, as well as convert these hydrocarbon sources into high-value chemicals to meet specific market needs. Currently there are abundant worldwide supplies of coal as well as a large market supply of petrochemical coke in the U.S. market. High boiling point liquid hydrocarbons, such as tars, bitumens, crude resides are also in great abundance and are expensive to upgrade by conventional refining technologies into useable liquid fuel sources. The vast majority of these supplies may be utilized to fuel liquid or solid fired electrical plants in the United States or are shipped oversees as low cost fuels for foreign electrical generation.

However, with current gasification technologies, these hydrocarbon fuel sources can be used to produce significantly more attractive liquid fuels products, such as gasolines and diesel fuels, through the partial-oxidation of these hydrocarbon fuels in a gasifier to produce a syngas product. These solid and high boiling point hydrocarbon feeds, such as tars, bitumens, crude resides, coal, petrochemical coke, and/or solid biomass, contain hydrogen and carbon, and can be partially oxidized at elevated temperatures in the presence of an oxidizing gas or vapor, such as air, oxygen, and/or steam to produce a "syngas" product. The chemistry for producing a syngas from hydrocarbon sources is well known in the industry and appropriate feeds and operating conditions can be selected to optimize the chemical reactions in producing the syngas.

The produced syngas is preferably comprised of hydrogen ($H_2$) and carbon monoxide (CO). This syngas can then be converted into valuable liquid transportation fuels, such as gasoline and diesel, through various catalytic reforming processes. The most common and well-known of these processes is the Fisher-Tropsch process which was developed by German researchers in the 1920's. In a Fisher-Tropsch process, the syngas is reformed in the presence of a catalyst, typically comprised of iron and/or cobalt, wherein the syngas is converted into chained hydrocarbon molecules. The following formula illustrates the basic chemical process involved in the Fisher-Tropsch reaction:

$$(2n+1)H_2+nCO \rightarrow C_nH_{(2n+2)}+nH2O \quad [1]$$

In conversion processes for the production of transportation fuels, the conditions are generally optimized to maximize conversion of the reaction products to higher boiling point hydrocarbon compounds with carbon contents of about 8 to about 20 carbon atoms. As with the syngas production process described above, various chemical processes for the conversion of syngas into liquid hydrocarbon transportation fuels are well known in the art.

Other processes include the conversion of these disadvantaged hydrocarbon feed into syngas (predominantly hydrogen and carbon monoxide) for use as a "clean fuel" in electrical production. The syngas produced by the process retains a relatively high BTU value as compared to the solid and/or high boiling point hydrocarbon feeds from which it is derived. Especially problematic for clean fuel production can be hydrocarbon feeds that are fossil fuel based (such as tars, bitumens, crude resides, coal and petroleum coke), as these feeds may contain a significant amount of contaminants such as sulfur and/or nitrogen. These contaminants can be damaging to power generating equipment as well as pose environmental emissions impacts on commercial processes. By first gasifying these disadvantaged or contaminated hydrocarbon fuels, these contaminants gasified in the process can be more easily removed prior to be using as a gas fuel for power generation than when in the liquid or solid hydrocarbon. These "clean" fuels can then be used as a combustion fuel for high speed gas turbines or for producing steam for steam driven turbines in the industrial production of electrical power.

The benefit of using these solid and high boiling point hydrocarbon fuel sources is that they are economic fuels relative to low boiling point liquid or gas hydrocarbon fuels, especially when such low boiling point liquid or gas hydrocarbon fuels can compete as alternative fuel sources in the as transportation or home heating fuels. This is also due in part to the often significant contaminants (such as sulfur and nitrogen) that are not easily removed from the solid fuel source, often relenting their use to commercial operations which can remove these contaminants as part of the integrated industrial processes.

One significant problem that exists in the gasification industry is materials that have both high temperature strength as well as high corrosion resistance due to the high temperatures and atmosphere associated in the gasification reactor. The reaction temperatures in modern solid and high boiling point hydrocarbon liquid (or "oil") gasifier reactors can typically exceed 4500° F. or even 5000° F. At these high temperatures conventional high temperature metallurgies such as high chromium/nickel steels are above their melting point and require cooling and metallurgies at these high temperatures exhibit significant reductions in mechanical strength as well as significantly lower corrosion resistance and erosion resistance.

What is needed in the industry is improved gasifier reactor components that exhibit improved strength, corrosion resistance and erosion resistance under the harsh conditions present in a gasifier reactor.

SUMMARY OF THE INVENTION

In an embodiment of the present invention an entrained-flow gasifier reactor comprising a gasifier faceplate made from a corrosion-resistant faceplate material comprised of an aluminum nitride. In a more preferred embodiment, the gasifier faceplate further comprises integral cooling channels. In an even more preferred embodiment of the present invention, the corrosion-resistant faceplate material is an AlN/metal composite material which is comprised of a metal selected from zirconium (Zr), aluminum (Al), and titanium (Ti).

In another preferred embodiment of the present invention, the entrained-flow gasifier reactor comprises a reactor wall wherein at least a portion of the reactor wall is comprised of a corrosion-resistant material selected from aluminum nitride and an aluminum-nitride/metal composite. Preferably, at least a portion of the reactor wall is in thermal contact with cooling tubes comprised of copper, aluminum, brass, Ni/Cr alloy steel, or stainless steel. In another preferred embodiment, the entrained-flow gasifier reactor comprises a reactor wall wherein at least a portion of the reactor wall is a monolith comprised of a corrosion-resistant material selected from aluminum nitride and an aluminum-nitride/metal composite wherein the monolith is further comprised of integral cooling channels formed from the aluminum nitride or aluminum-nitride/metal composite materials.

In yet another preferred embodiment of the present invention, is an entrained-flow gasifier reactor comprising reactor wall cooling tubes that substantially consist of a corrosion-resistant material selected from aluminum nitride and an aluminum-nitride/metal composite.

DETAILED DESCRIPTION OF THE INVENTION

The present invention utilizes an aluminum-nitride ("AlN") material or optionally, an aluminum-nitride containing material for forming a gasifier reactor faceplate or other components of a gasifier reactor that are exposed to the reaction zone of the gasifier reactor. Preferred aluminum-nitride containing (or "AlN/metal composites") materials are comprised of aluminum nitride in combination with a metal. Preferred metallic components for the AlN/metal composites are zirconium (Zr), aluminum (Al), and titanium (Ti).

Most commercially viable solids and high boiling point liquid hydrocarbon gasifier reactor units are comprised of a burner assembly through which the hydrocarbonaceous solid or liquid material is injected through a port or series of ports while an oxygen-containing gas is injected through a proximate port or series of ports. Generally, the burners or burner assembly is set in the faceplate of the gasifier reactor. For the purposes of this application, the gasifier faceplate is any component(s) of the gasifier reactor to which (or through which) a gasifier burner assembly is attached and which is exposed to the reaction zone of the gasifier reactor. The reaction zone of the gasifier reactor is defined as the zone inside the gasifier reactor wherein the gasifier feed component (i.e., the solid or liquid hydrocarbon feed and the oxygen-containing gas) undergo thermal and oxidative conversion to synthetic gas ("syngas") products. While this region differs somewhat between differing reactor designs and sizes, the combustion reaction zone generally includes a region from the gasifier reactor faceplate to anywhere from about 0.1 to about 10 feet downstream from the burner face.

Figure 1:
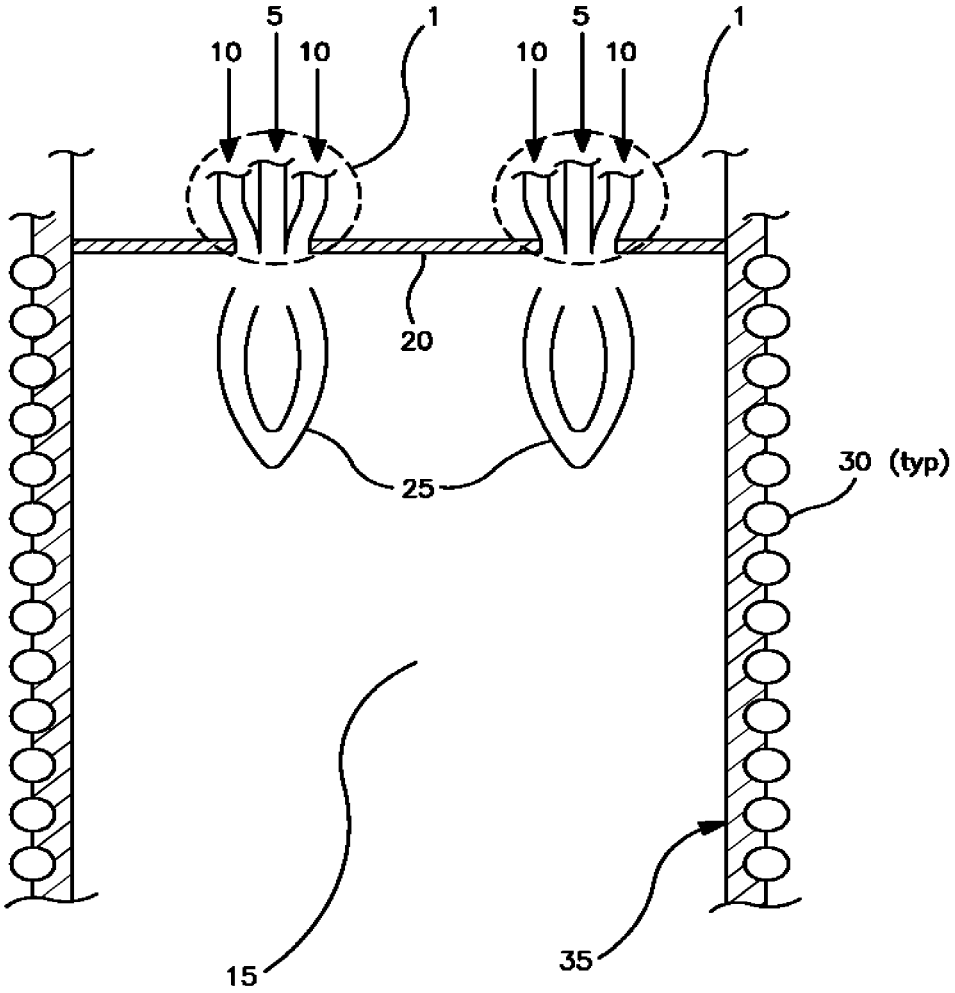
FIG. 1 is simplified partial schematic of a typical entrained-flow gasifier reactor incorporating components of the present invention.

A simplified partial schematic of a typical gasifier reactor incorporating the aluminum nitride based components of the present invention is shown in FIG. 1. It should be noted that the schematic shows a downflow gasifier reactor arrangement (i.e., the flow of the feed and products is from the top of the gasifier reactor to the bottom). However, the same invention as described herein can apply to any gasifier reactor design, including upflow gasifier reactors as well as gasifiers wherein the burners are installed in the side walls of the gasifier reactor. The simplified gasifier reactor schematic shown in FIG. 1 only illustrates an elevated cross-section of the reactor to illustrate some of the key components of the present invention. The gasifier reactor schematic shown in FIG. 1 also only illustrates two burner assemblies, but in practical installations, the number of the burners is typically in excess of about four burners per reactor.

What is illustrated in FIG. 1 is a representative burner, faceplate, and cooling wall relative arrangement incorporating the elements of the present invention. Though only two burners are illustrated, typically, there are multiple burner assemblies (1) which are comprised of at least one fuel feed port (5) and at least one oxidizing gas port (10), through which the solids and/or high boiling point liquid hydrocarbon feed stream, and the oxygen-containing gas stream, respectfully, are introduced into the combustion chamber (15) of the gasifier reactor. The burners are set in or attached to a reactor faceplate (20) which may include cooling. A flame front (25) is produced from the combustion of the fuels, thus converting the solids and/or high boiling point liquid hydrocarbon fuels into syngas products. The walls of the reactor may be cooled by cooling tubes (30) to limit the temperature of the reactor wall (35).

It should be noted that the term "solids" or "solids fuels" as use herein is defined as any hydrocarbon-containing material that can be combusted to form syngas products and are solids at atmospheric temperatures and pressures. Non-limiting examples of solid fuels which may be utilized in the gasification processes herein are coal, petrochemical coke, and solid biomass sources. As used herein "high boiling point liquid hydrocarbons" are hydrocarbons that are flowable liquids at temperatures above about 200° F. (but below their vaporization temperature) and which contain hydrocarbon-components with boiling points above about 500° F., preferably above about 650° F. at atmospheric pressure. Non-limiting examples of high boiling point liquid hydrocarbon fuels which may be utilized in the gasification processes herein are fuels streams comprised of tars, bitumens, crude resides, coal and/or liquid biomasses. The term "biomasses" as used herein are defined as any material that is obtained directly from or derived from renewable biological sources and excludes fossil fuels.

In the prior art, high strength alloy metal components are typically used for faceplate fabrication. These high alloys are typically high in nickel and chromium content and can also incorporate other metallic elements such as molybdenum, cobalt, or tungsten to improve corrosion resistance and/or impart high temperature strength characteristics. Exemplary metal alloys materials for these services go by the trademarks of Hastelloy® or Haynes® (trademarks of Haynes International Inc.) as well as the trademarks of Inconel® and Incoloy® (trademarks of Special Metals Corp.). These alloys may also include a coating material, applied by techniques known in the art, to provide additional corrosion and/or erosion resistance. However, a major problem that exists with using high alloy metal components for either the faceplate or the reactor wall is that at these highly adverse and volatile conditions in the combustion chamber (15), particularly in the area of the combustion zone, even these metal alloys developed for severe services exhibit significant levels of corrosion and erosion and thus are not suitable for long-term continuous operation of most commercial units. Additionally, all of these metal alloy materials require substantial cooling to maintain their surface temperatures below the melting point of the materials. Refractory materials are also sometimes used in the gasifier reactors of the prior art to cover the faceplates or gasifier reactor walls, but these materials can also deteriorate under the corrosive conditions as well as cause additional problems with limiting efficient heat removal from the combustion chamber, including the combustion zone. Yttria-stabilized zirconia is an example of a thermal barrier (refractory) coating used in related arts as a thermal insulator.

While it has been known that the environment in the combustion zone is very oxidizing (and as such, the general selection/use of "non-oxidizing" metal alloys in the prior art) it has been discovered herein that the gasifier reactor components in the vicinity of the combustion zone are simultaneously, as well as intermittently, exposed to a combination of oxidizing, reducing and carburizing environments. Additionally, especially when solid combustible fuel materials are used in the process, due to particulate matter passing through the burners and the high injection velocities, the gasifier reactor components in the vicinity of the combustion zone are exposed to a very erosive environment. As such, these corrosion and erosion mechanisms most often work in conjunction with one another to quickly deteriorate and erode away the faceplate and reactor wall components by first causing corrosion followed by eroding away of the corroded layer, thus re-exposing new metal and continuing the deterioration cycle.

In the Example herein, the corrosivity products of aluminum nitride ("AlN") was compared to typical elements of high alloy steels (Cr, Fe, and Ni) to determine the stability of these materials under all three of oxidizing, reducing, and carburizing environments. As can be seen in the Example, it has unexpectedly been discovered that out of the materials evaluated in the example, only the AlN material withstands all three environments to a substantial extent (i.e., to within less than 0.01% extraneous corrosion products) and forms a protective layer of aluminum oxide ($Al_2O_3$) on the surface of the aluminum nitride under all three corrosive environments. It should also be noted that out of the metals in Example 1, only chromium has a corrosion stability approaching AlN, but due to the high temperatures experienced in a gasifier reactor chromium cannot be used as a pure or substantially pure metal and must be mixed with other elements (typically nickel and/or iron) in order to achieve mechanical stability under high temperatures. However, it can be seen that the nickel component is subject to high levels of non-protective corrosion product formation, especially under reducing environments experienced in the gasifier reactor combustion zone. As such, such nickel alloys are particularly subject to grain and grain boundary corrosion mechanisms.

Figure 2:
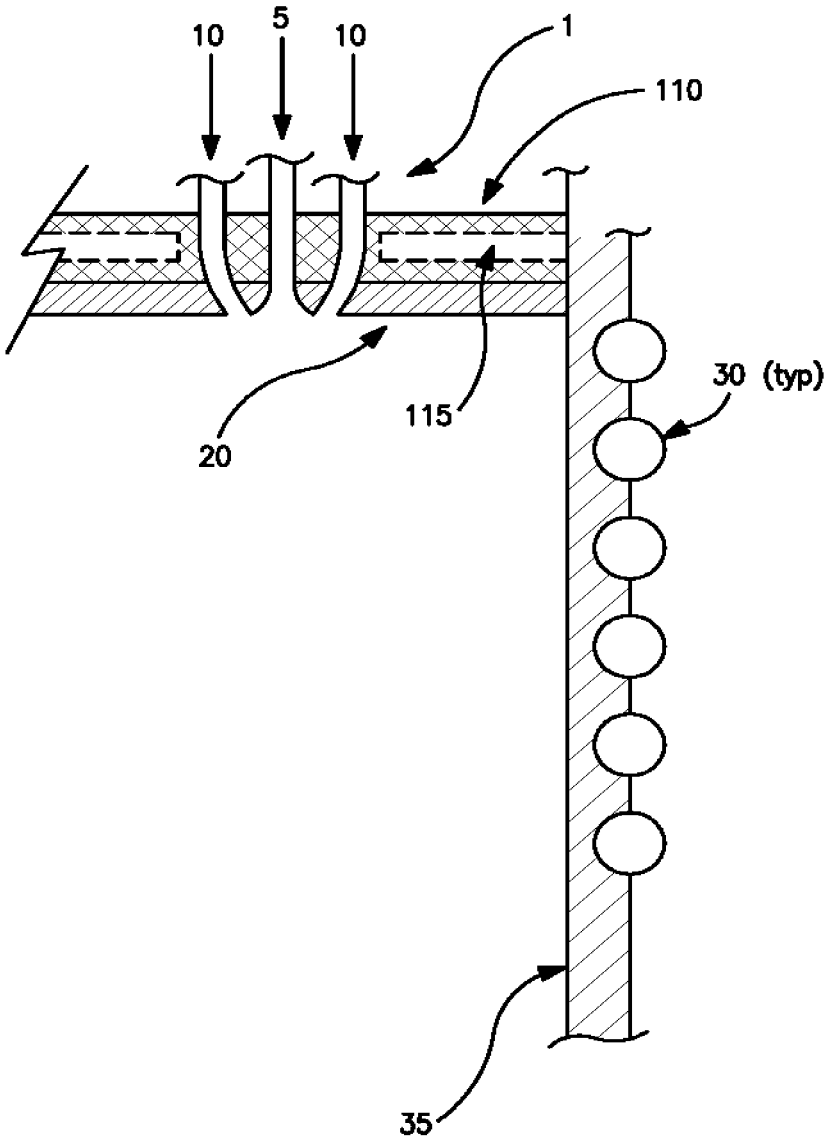
FIG. 2 is an exploded view of FIG. 1 also illustrating additional components of the present invention.

As illustrated in FIG. 2 is an exploded section of the burner/faceplate section and a portion of the reactor wall and cooling tube section of FIG. 1, further illustrating embodiments of the present invention. Here, a single burner (1) is shown as installed/inserted within the aluminum nitride or aluminum nitride/metal composite material faceplate ("AlN faceplate") (20) of the present invention. The burner incorporates the fuel feed port (5) and at least one oxidizing gas ports (10) as similar to FIG. 1. Also shown in FIG. 2 is an aluminum nitride or an aluminum nitride/metal composite material reactor wall (35) of the present invention, with cooling tubes (30). Also shown is an optional cooling plate (110) that is in contact with the AlN faceplate (20) and contains cooling channels (115) through which a cooling fluid may be circulated.

As illustrated in the Example herein, the AlN materials have unexpectedly shown a high corrosive resistance to all three oxidizing, reducing, and carburizing environments and thus can be used as exemplary materials for gasifier faceplates and gasifier wall construction. An additional benefit to using the AlN materials is that AlN materials possess very high thermal coefficients which can be very beneficial for their use in these particular elements. In particular, it can be desired to cool the walls of the reactor in order to form a layer of slag on the reactor walls (35). This slag can help protect the reactor wall from further corrosion and erosion as well as reduce the facial temperature of the material comprising the vessel wall. Here the AlN material is quite beneficial in transferring heat through the reactor walls (35) to the cooling tubes (30). The thermal conductivity of the AlN far surpasses high alloy materials (such as Haynes 188) as well as stainless steels (310 SS) and approaches thermal conductivities of some of the best heat conductive materials (such as oxygen free high conductivity "OFHC" coppers). These thermal conductivities are listed in Table 1 below:

TABLE 1

Thermal conductivity comparison between potential gasifier materials

| Material | AlN Composite | OFHC Copper | Haynes 188 ® | 310 SS |
|---|---|---|---|---|
| Conductivity (BTU-in/ft$^2$-hr-° F.) | 1250-1530 | 2630 | 72 | 92 |

The table above also illustrates another problem with utilizing the high alloy materials (such as Haynes 188® or stainless steel) as reactor faceplate or reactor walls components. That is, due to the low thermal conductivity of these materials, the components tend to experience high thermal stress gradients under the high temperatures in the gasifier reaction zone which further increases the stresses on the materials.

In contrast, the AlN composite materials, in addition to their superior corrosion resistance, have high thermal conductivities, thus allowing the materials to experience more uniform thermal gradients and lower stress forces. Another benefit is that the AlN and the AlN/metal composites can be formed by either sintering or hot pressing, thus making these materials very simple to fabricate into almost any shape.

It is desirable to use the AlN or AlN/metal composite materials as a gasifier faceplate (20) in conjunction with a cooling plate (110) to remove the heat from the faceplate wall as well as the combustion reaction zone. In a separate embodiment, it is desirable to use the AlN or AlN/metal composite materials as a reactor wall material (35) in conjunction with cooling tubes (30) to remove the heat from the combustion chamber wall as well as the combustion reaction zone. These AlN and/or AlN/metal composites can be formed to fit integrally with the cooling plate or cooling tubes providing a high degree of thermal flux. In a preferred embodiment, the AlN and/or AlN/metal composite materials can be brazed onto the cooling plate or cooling tubes. Suitable wetting agents and brazing techniques as known in the art can be utilized to braze the AlN and/or AlN/metal composite materials to the cooling plate or cooling tubes to provide improved strength and thermal conductivity. In these embodiments, it is preferred that the cooling plate or cooling tubes are fabricated from high thermal conductivity materials such as copper, aluminum, brass as well as alloys containing copper, aluminum, or brass. Other suitable cooling plate or cooling tube materials are Ni/Cr alloy steels and stainless steels as these materials will be protected from the corrosive environment and have a high strength when associated with the lower temperatures of the cooling plate or cooling tubes.

Figure 3:
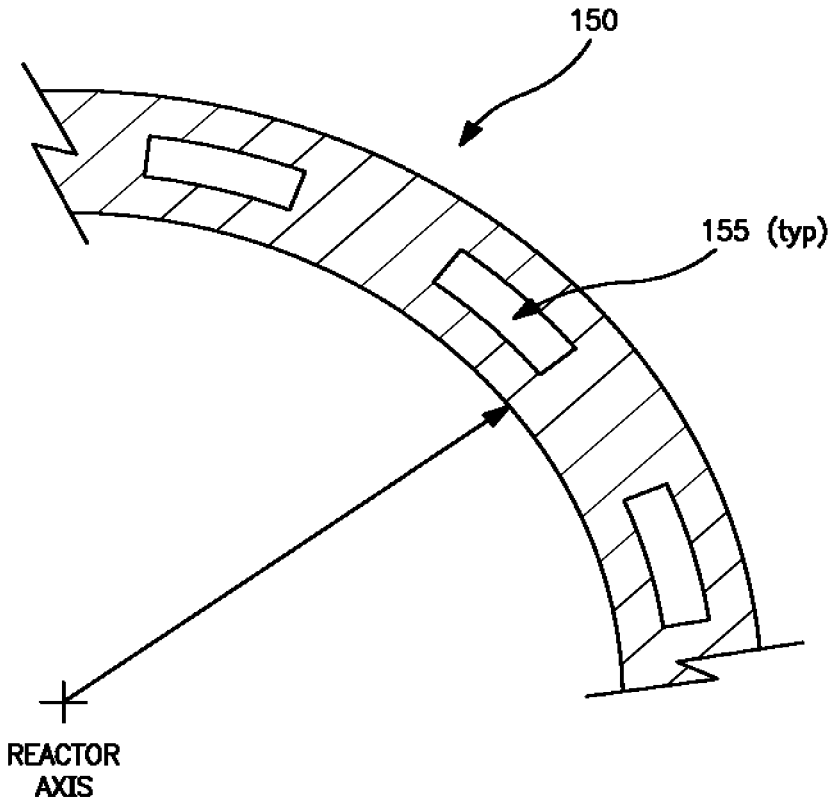
FIG. 3 is partial schematic of a gasifier reactor wall of the present invention with integrated cooling channels.

In yet another embodiment of the present invention, at least a portion of the reactor wall and the cooling tubes can be integrated into a single monolith made from AlN and/or AlN/metal composite materials. An embodiment of this integrated reactor wall/cooling channels is shown in FIG. 3, which is a partial section, elevation view of the reactor wall, wherein the reactor wall/cooling channel component (150) is comprised of AlN and/or AlN/metal composite materials. Here the cooling channels (155) are oriented parallel to the axis of the reactor which provides for ease in fabrications of the module (s). The channels may be any shape or size to facilitate the amount of cooling required as well as uniform cooling of the reactor wall. In this embodiment, the benefits include the elimination of joints, the elimination of brazing between the tubes and wall, the existence of a reactor wall pressure boundary, uniform thermal expansion, as well as the excellent thermal conductivity and corrosion resistance exhibited by the AlN and/or AlN/metal composite materials.

As an additional benefit, the AlN and AlN/metal composite materials have exceptional erosion resistances. As noted prior, this is particularly important in the gasifier reactor where high velocities and particulates are present in combination with highly corrosive environment. A comparison of the hardnesses of potential gasifier materials is shown below in Table 2.

TABLE 2

Material hardness comparison between potential gasifier materials

| Material | AlN | Copper | Haynes 188 ® | 310 SS |
|---|---|---|---|---|
| Vickers Hardness (GPa) | 12 | <1 | 3 | 2-3 |

Although the present invention has been described in terms of specific embodiments, it is not so limited. Suitable alterations and modifications for operation under specific conditions will be apparent to those skilled in the art. It is therefore intended that the following claims be interpreted as covering all such alterations and modifications as fall within the true spirit and scope of the invention.

The benefits of embodiments of the present invention are further illustrated by the following example.

EXAMPLE

Comparative Data of Material Corrosion Products

Similar to other high temperature materials, when AlN composites are exposed to corrosive gas mixtures, these gases will interact with the surface of the material and form an interface layer, called a scale, which separates the high temperature gases from the bulk material. This scale is composed of reaction products between the base material and gases. The faceplate and reactor wall of an entrained-flow gasifier could potentially be exposed to many different corrosive gas mixtures including oxidizing, reducing, carburizing or metal-dusting (metal dusting will have the same/similar gas composition as carburizing, but isolated to a specific temperature range).

In this example, thermodynamic equilibrium calculations were completed for select possible reactor materials simulating effects when exposed to an excess of these gas mixtures at a temperature (1500° F.) and pressure (400 psi) that would yield conditions representative of the injector faceplate (with back cooling) to determine the composition of the scale likely to form when materials/composites are exposed to each of these gas mixtures. These calculations were performed on aluminum nitride ("AlN") and repeated for primary components of superalloy materials, namely Cr, Ni and Fe, giving a direct comparison of expected corrosion products.

The results of these calculations are presented in Table 3 below.

TABLE 3

Comparison of corrosion products for select materials

| Material and resulting corrosion products | Thermodynamic equilibrium product mixture (mole fraction) of AlN, Cr, Fe & Ni when exposed to oxidizing, reducing or carburizing gas mixtures[a] | | |
|---|---|---|---|
| | Oxidizing[b] | Reducing[c] | Carburizing[d] |
| AlN | | | |
| $Al_2O_3$ | ***0.99943*** | ***0.99990*** | ***0.99990*** |
| $Al_2O_3 \bullet H_2O$ | 0.00038 | 9.51E−05 | 0.00010 |
| $Al(OH)_3$ | 3.90E−07 | | |
| $Al(OH)_3$ (g) | 8.60E−07 | 9.14E−06 | |
| $Al_2(SO_4)_3$ | 0.00020 | | |
| Cr | | | |
| $Cr_2O_3$ | ***0.85844*** | ***0.99609*** | ***1.00000*** |
| $CrO_2$ | ***0.02304*** | | 2.94E−07 |
| $CrO_3$ | 0.00014 | | |
| $CrO_2(OH)_2$ (g) | ***0.11818*** | | |
| $CrO_2(OH)$ (g) | 8.53E−05 | | |
| $CrO(OH)_3$ (g) | 5.41E−06 | | |
| $Cr_2(SO_4)_3$ | 0.00011 | | |
| $CrS_{1.17}$ | | 0.00331 | |
| CrS | | 0.00060 | |
| Cr | | | 4.28E−07 |
| Fe | | | |
| $Fe_2O_3$ | ***0.97238*** | 0.00017 | 0.00403 |
| FeO | 0.00011 | ***0.01430*** | ***0.28045*** |
| $Fe_{0.945}O$ | 0.00055 | ***0.01716*** | ***0.29115*** |
| $Fe_3O_4$ | 0.00496 | 1.14E−06 | 0.00911 |
| $FeO \bullet OH$ | 0.00746 | 5.06E−06 | 0.00011 |
| $Fe(OH)_2$ | | 1.08E−06 | 2.29E−05 |
| $Fe(OH)_2$ (g) | | 9.73E−06 | 0.00026 |
| $FeSO_4$ | ***0.01419*** | | |
| $Fe_2(SO_4)_3$ | 0.00035 | | |
| FeS | | ***0.57405*** | |
| $Fe_{0.877}S$ | | ***0.37666*** | |
| $FeS_2$ | | 0.00035 | |
| $Fe_3C$ | | 1.48E−05 | ***0.09162*** |
| Fe | | ***0.01726*** | ***0.32324*** |
| Ni | | | |
| NiO | ***0.17399*** | 0.00041 | 0.00264 |
| $NiO \bullet OH$ | 6.65E−06 | | |
| $Ni(OH)_2$ | 2.52E−05 | | |
| $Ni(OH)_2$ (g) | 3.23E−05 | | |
| $NiSO_4$ | ***0.82595*** | | |
| NiS | | ***0.14684*** | |
| $Ni_3S_2$ | | ***0.69370*** | |
| $NiS_2$ | | 0.00024 | |
| $Ni_3S_4$ | | 8.15E−06 | |
| $Ni_3C$ | | 3.84E−05 | 0.00867 |
| $Ni(CO)_4$ (g) | | | 3.39E−06 |
| Ni | | ***0.15876*** | ***0.98869*** |

[a]Thermodynamic equilibria determined using the program HSC Chemistry, ver. 5.11. Products having >0.01 abundance are bolded/italicized. Conditions were 1500° F. and 400 psi.
[b]Oxidizing gas mixture (mole fraction) = 0.532 $O_2$, 0.104 $CO_2$, 0.320 $H_2O$, 0.040 $N_2$, 0.00191 $SO_2$.
[c]Reducing gas mixture (mole fraction) = 0.070 $O_2$, 0.080 $CO_2$, 0.539 CO, 0.300 $H_2$, 0.010 $H_2S$.
[d]Carburizing gas mixture (mole fraction) = 0.070 $CO_2$, 0.091 $H_2O$, 0.539 CO, 0.30 $H_2$.

Under oxidizing, reducing and carburizing conditions, it is clear that the corrosion product of AlN overwhelming favored by thermodynamics is $Al_2O_3$. This is not the case for the common components of superalloys. In the case of Cr, $Cr_2O_3$ is thermodynamically favored in all gas environments, however, in the case of oxidizing environments, an additional form having 0.11818 mole fraction would be volatile under these conditions, which would result in material loss.

For iron, a number of different products are expected. Under oxidizing conditions, the thermodynamically favored product is $Fe_2O_3$ with other iron-oxide forms and iron sulfates contributing to the product distribution. Under reducing conditions, iron sulfides comprise 95 mol % of the products, and in carburizing conditions, iron oxides, iron carbide, and unconverted carbon are predicted to predominate.

In the case of nickel, oxidizing conditions are thermodynamically predicted to yield nickel sulfate and nickel oxide as the major components, while reducing gases favor the formation of nickel sulfides. To a limited extent, carburizing conditions are predicted to yield nickel oxide and nickel carbide.

Taken together, only for AlN would a similar corrosion product be present when exposed to different gas compositions. This is particularly important near the faceplate of the gasifier as well as in the combustion zone, where multiple corrosion mechanisms are possible due to fluctuating gas compositions.

This analysis is somewhat limited in that superalloys are a mixture of multiple components and the thermodynamics predictions were completed individually. Nonetheless, the well documented corrosion mechanism of superalloys starts with the formation of a $Cr_2O_3$ product at the interface between the alloy and corrosive gases. This layer is dynamic and will recede and become replenished by additional chromium as it diffuses from the base alloy to the interface layer. However, over time, chromium will become depleted from the base alloy and the iron and nickel components will become exposed. The aforementioned analysis suggests the establishment of iron and nickel components at this interface to consist of significantly less protective corrosion products and their formation will not slow material loss as readily as $Cr_2O_3$. In the case of AlN (or an AlN/Al metal composite), only a single phase would be expected to form at the interface between corrosive gases and base material, which will be replenished only with additional Al, rather than components that do not form protective interface layers, such as what would be expected from superalloy materials.

What is claimed is:

1. An entrained-flow gasifier reactor comprising:

a gasifier faceplate having at least one fuel feed port and at least one oxidizing gas port passing therethrough, the gasifier faceplate formed of a corrosion-resistant faceplate material comprised of an aluminum nitride;

a fuel feed line providing a solid fuel feed or high boiling point liquid hydrocarbon feed to the at least one fuel feed port; and a reactor wall extending away from the gasifier faceplate.

2. The entrained-flow gasifier reactor of claim 1, wherein the corrosion-resistant faceplate material is in the sintered or hot pressed condition.

3. The entrained-flow gasifier reactor of claim 1, wherein the gasifier faceplate further comprises integral cooling channels.

4. The entrained-flow gasifier reactor of claim 1, further comprising a cooling plate that is in thermal contact with the gasifier faceplate.

5. The entrained-flow gasifier reactor of claim 4, wherein the cooling plate is mechanically attached to the gasifier faceplate by means of a brazing agent.

6. The entrained-flow gasifier reactor of claim 4, wherein the cooling plate is comprised of copper, aluminum, or brass.

7. The entrained-flow gasifier reactor of claim 6, wherein the cooling plate is comprised of oxygen free high conductivity ("OFHC") copper.

8. The entrained-flow gasifier reactor of claim 1, wherein the corrosion-resistant faceplate material is further comprised of a metal selected from the group consisting of zirconium (Zr), aluminum (Al), and titanium (Ti).

9. The entrained-flow gasifier reactor of claim 1, wherein the corrosion-resistant faceplate material consists essentially of aluminum nitride.

10. The entrained-flow gasifier reactor of claim 1, wherein at least a portion of the reactor wall is comprised of a corrosion-resistant reactor wall material selected from the group consisting of aluminum nitride and an aluminum-nitride/metal composite.

11. The entrained-flow gasifier reactor of claim 10, wherein said portion of the reactor wall is a monolith further comprising integral cooling channels.

12. The entrained-flow gasifier reactor of claim 11, wherein said portion of the reactor wall consists essentially of a corrosion-resistant reactor wall material selected from the group consisting of aluminum nitride and an aluminum-nitride/metal composite.

13. The entrained-flow gasifier reactor of claim 12, wherein the corrosion-resistant reactor wall material is an aluminum-nitride/metal composite, wherein the metal component is selected from the group consisting of zirconium (Zr), aluminum (Al), and titanium (Ti).

14. The entrained-flow gasifier reactor of claim 1, further comprising reactor wall cooling tubes that consist essentially of a corrosion-resistant cooling tube material selected from the group consisting of aluminum nitride and an aluminum-nitride/metal composite.

15. The entrained-flow gasifier reactor of claim 14, wherein the corrosion-resistant cooling tube material is an aluminum-nitride/metal composite, wherein the metal component is selected from the group consisting of zirconium (Zr), aluminum (Al), and titanium (Ti).

* * * * *